US007198429B2

(12) United States Patent
LeJeune et al.

(10) Patent No.: US 7,198,429 B2
(45) Date of Patent: Apr. 3, 2007

(54) SEGMENTED CONCRETE SCREED

(75) Inventors: Michael LeJeune, Wayzata, MN (US); Jason Hensley, Shakopee, MN (US); Thomas Kuckhahn, Prior Lake, MN (US); Donald Hall, New Prague, MN (US); Richard Wesen, Westfield, IN (US); Joseph Novotny, New Prague, MN (US)

(73) Assignee: Fabcon, Inc., Savage, MN (US)

( * ) Notice: Subject to any disclaimer, the term of this patent is extended or adjusted under 35 U.S.C. 154(b) by 0 days.

(21) Appl. No.: 10/815,087

(22) Filed: Mar. 31, 2004

(65) Prior Publication Data

US 2005/0253041 A1 Nov. 17, 2005

(51) Int. Cl.
*E01C 19/22* (2006.01)

(52) U.S. Cl. ..... 404/96; 404/118

(58) Field of Classification Search ..... 404/75, 404/84.05, 84.1, 90, 92, 93, 96, 98, 101, 404/118, 119, 84.8
See application file for complete search history.

(56) References Cited

U.S. PATENT DOCUMENTS 1,390,479 A * 9/1921 Baker ..... 404/96
1,627,731 A * 5/1927 Fitzner ..... 37/383
1,780,427 A * 11/1930 Kirkham ..... 404/119
1,883,667 A * 10/1932 Flynn ..... 37/385
2,094,910 A * 10/1937 Baily ..... 404/96
2,312,968 A * 3/1943 Heltzel ..... 404/119
2,412,398 A * 12/1946 Harsch ..... 404/113
2,864,290 A * 12/1958 Freeman ..... 404/98
3,054,334 A * 9/1962 Barber et al. ..... 404/108
3,217,375 A 11/1965 Kinnard ..... 425/130
3,416,416 A * 12/1968 Long et al. ..... 404/96
3,453,939 A * 7/1969 Fairchild et al. ..... 404/84.05
3,523,343 A 8/1970 Mitchell ..... 425/88
3,541,934 A * 11/1970 Hughes et al. ..... 404/120
3,559,544 A * 2/1971 Miller ..... 404/96
3,605,579 A * 9/1971 Heltzel ..... 404/93
4,004,874 A 1/1977 Foster ..... 425/438
4,289,293 A 9/1981 Cashion ..... 249/74
4,364,690 A * 12/1982 Bruns ..... 404/118
4,379,653 A * 4/1983 Brown ..... 404/118
4,457,682 A 7/1984 Nash et al. ..... 425/219
4,621,944 A * 11/1986 Jordense ..... 404/75
4,852,278 A * 8/1989 Takizawa et al. ..... 37/197
4,854,769 A * 8/1989 Fukukawa et al. ..... 404/72
4,970,800 A * 11/1990 Takizawa et al. ..... 33/561.3
5,387,051 A * 2/1995 Valente ..... 404/84.05
5,401,115 A * 3/1995 Musil et al. ..... 404/72
5,405,214 A * 4/1995 Campbell ..... 404/80
5,568,992 A * 10/1996 Grembowicz et al. ..... 404/101
5,588,776 A * 12/1996 Swisher et al. ..... 404/72
6,056,474 A * 5/2000 Nolan ..... 404/118
6,273,636 B1 * 8/2001 Johanpeter ..... 404/104
6,520,715 B1 * 2/2003 Smith ..... 404/75
6,773,203 B2 * 8/2004 Casters ..... 404/84.1
6,799,922 B2 * 10/2004 Smith ..... 404/75
6,929,420 B2 * 8/2005 Kieranen et al. ..... 404/84.2

(Continued)

*Primary Examiner*—Gary S. Hartmann
(74) *Attorney, Agent, or Firm*—Vidas, Arrett & Steinkraus PA

(57) ABSTRACT

A segmented concrete screed for screeding concrete on a concrete casting bed includes a plurality of individual screed units each of which may be raised and lowered independently of the others such that screeding operations may selectively bypass obstructions in the concrete to be screeded.

3 Claims, 3 Drawing Sheets

U.S. PATENT DOCUMENTS 6,932,538 B2 * 8/2005 Heims ..... 404/118
6,988,849 B1 * 1/2006 Zimmerman ..... 404/95
2002/0110419 A1 * 8/2002 Batty et al. ..... 404/84.1
2003/0115822 A1 6/2003 Lejeune et al. ..... 52/677

* cited by examiner

SEGMENTED CONCRETE SCREED

CROSS-REFERENCE TO RELATED APPLICATIONS

None

STATEMENT REGARDING FEDERALLY SPONSORED RESEARCH OR DEVELOPMENT

Not Applicable.

BACKGROUND OF THE INVENTION

This invention relates to concrete casting machines which cast concrete panels. Previously, hollow core concrete panels have been formed by many methods, including single and multiple pass casting using moving beds and with stationary beds. The hollow cores are made by using slipform extruders that leave core material in place over which concrete is formed. Once cured, the panels are cut to length and lifted and tilted to remove the core material which may be reused.

Some hollow core panels have been made with an insulating layer across the entire surface, as shown in U.S. Pat. No. 4,628,653, the disclosure of which is incorporated herein by reference. Basically, a hollow core panel is cast and interlocking sheets of insulation are laid down before a final pour of concrete. This uniform layer of insulation increases the R-value of the finished wall panels and floor plank.

Recently, the assignee of this invention has developed a machine and process that uses foam billets to provide insulation and to eliminate the need for using slipform extruders and core material. The invention is described in published U.S. patent application US 20030115822A1 which was published on Jun. 26, 2003, the disclosure of which is incorporated herein by reference. A further benefit of this invention is that it allows casting concrete panels with openings therethrough, such as for windows. A pass through opening during casting means that current screed apparatus of casting machines will not function properly.

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. § 1.56(a) exists.

BRIEF SUMMARY OF THE INVENTION

The invention provides a modified concrete screed for machines for casting concrete panels which is adjustable so the screeding operation may bypass zones on the bed when desired.

The inventive segmented screed of the invention basically modifies any standard concrete casting apparatus as shown in U.S. Pat. Nos. 3,217,375; 3,523,343; 4,004,874; 4,289,293 and 4,457,682, the disclosures of which are incorporated herein by reference. Such casting machines have a casting bed that is either stationary or is driven along rails. The casting bed has a bottom pallet and side forms. Normally, a screed is positioned above the cast concrete between the side forms such that it may screed the poured top surface of the concrete. In this invention, the screed is modified such that it includes a plurality of segments, each of which may be raised or lowered independently of the others such that screeding may be bypassed at any desired location.

BRIEF DESCRIPTION OF THE DRAWINGS

A detailed description of the invention is hereafter described with specific reference being made to the drawings in which.

DETAILED DESCRIPTION OF THE INVENTION

Figure 1:
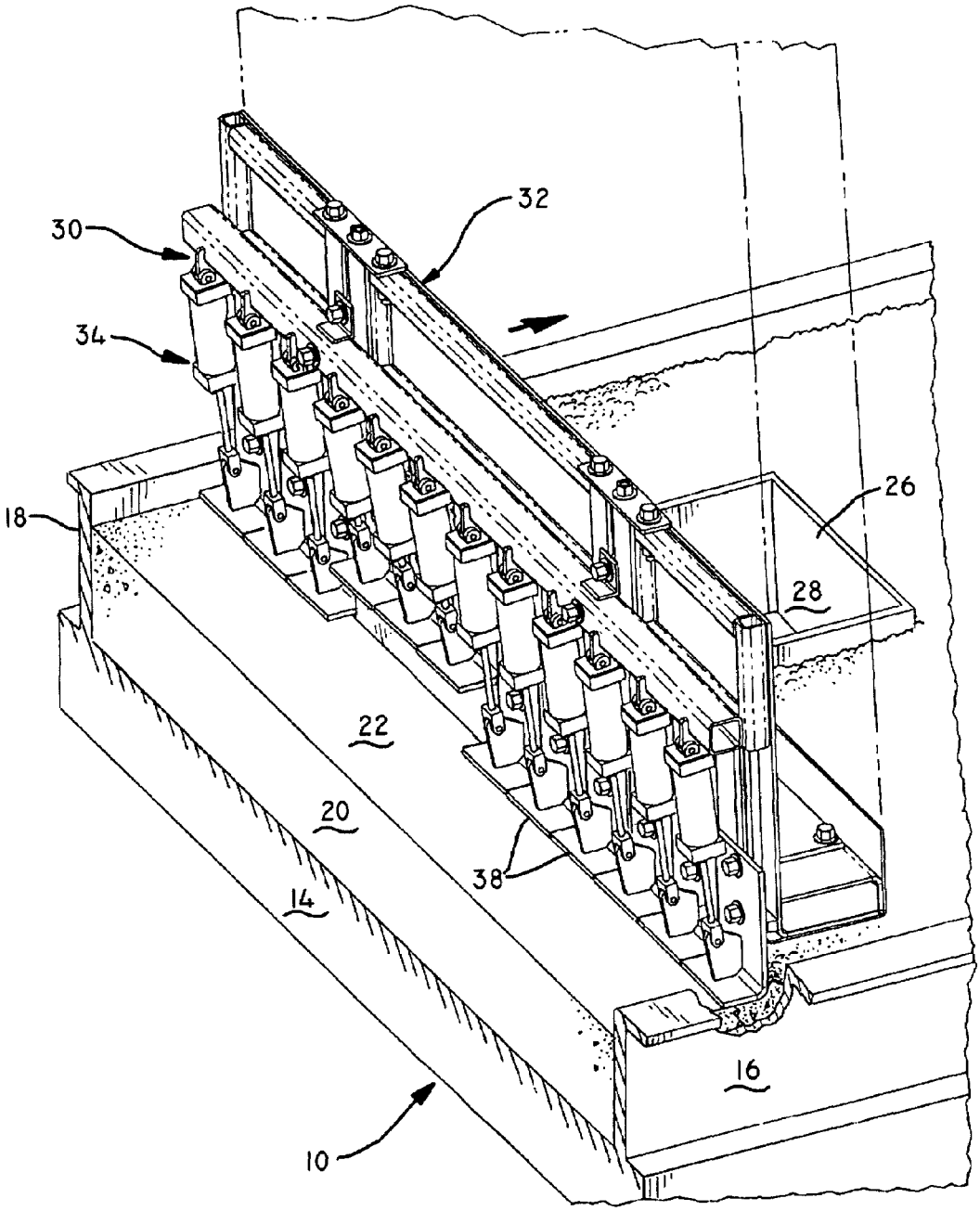
FIG. 1 is a perspective view of the segmented screed of the invention.

Casting machines which employ the segmented screed have a casting bed 10 that is either stationary or is driven along rails. The casting bed 10 has a bottom pallet 14 and side forms 16, 18. The concrete panel 20 being formed is shown in FIG. 1 and has an upper surface 22 which requires screeding. The concrete panel 20 shown includes one or more defined openings 28 and would typically include a plurality of foam billets as shown and described in published U.S. patent application U.S. 20030115822A1. That method allows concrete panels to be cast without the need to tilt the finished panels to remove core material from longitudinal voids. This allows the use of forms 26 which define a pass through opening 28. Unfortunately, the top of the forms 26 will interfere with prior art screeds.

Screed 30 of the invention, like existing screeds, is suspended above the bed 10 and is movable relative to the bed by the bed moving or by its being driven along the length of the bed. Screed 30 includes a framework 32 to which a plurality of screed units 34 are slidably attached via bolts 36 which allow the screed units 34 to be moved vertically relative to the framework 32. The screed units 34 each have a lower screed plate 38 which when combined with the other screed units provides the screeding of the concrete.

Lower screed plate 23 as shown in the drawings has a leading edge which hits the concrete and a flat bottom surface which smoothes the concrete.

Figure 2:
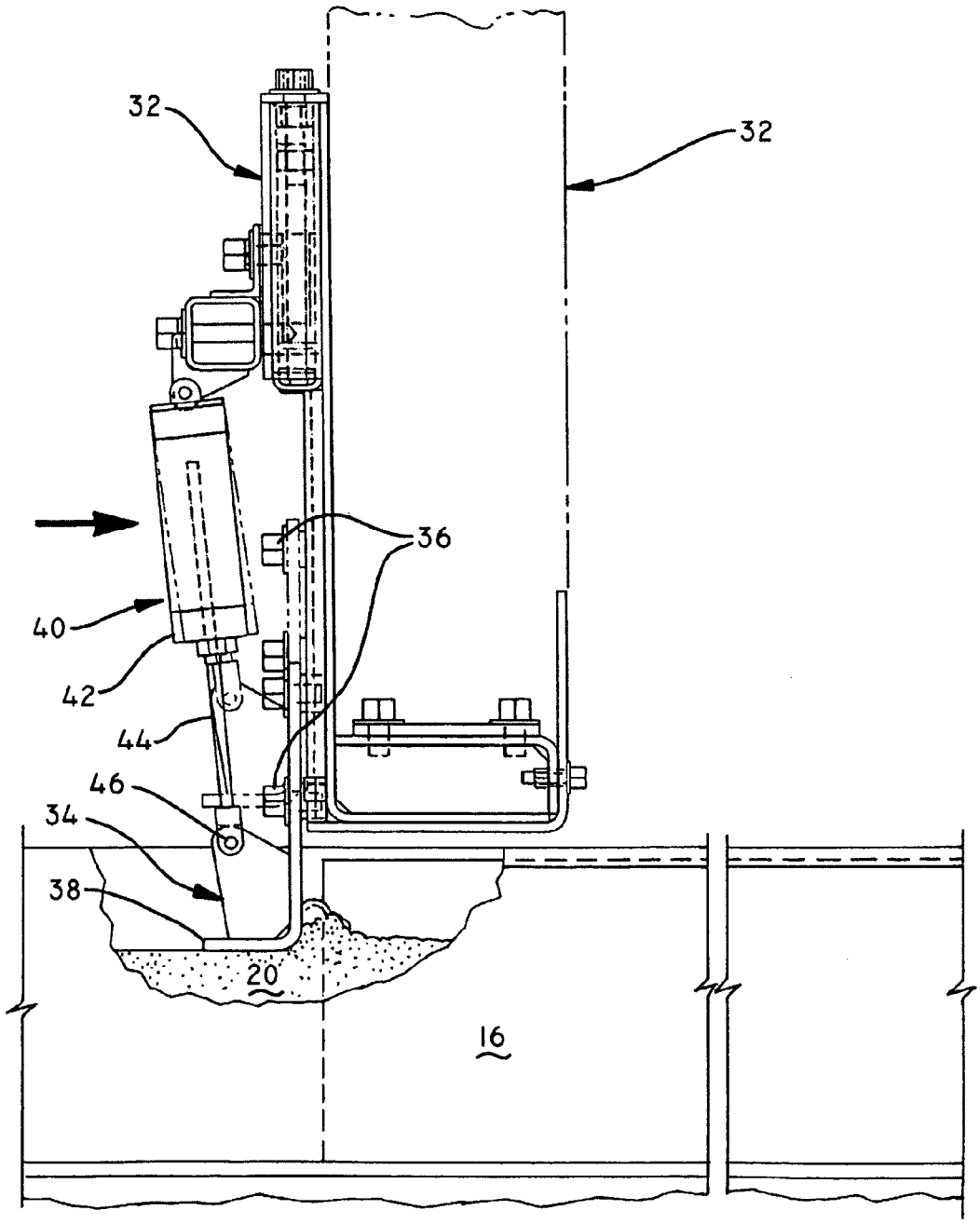
FIG. 2 is a side elevational view of the segmented screed showing a segment lowered against concrete.
Figure 3:
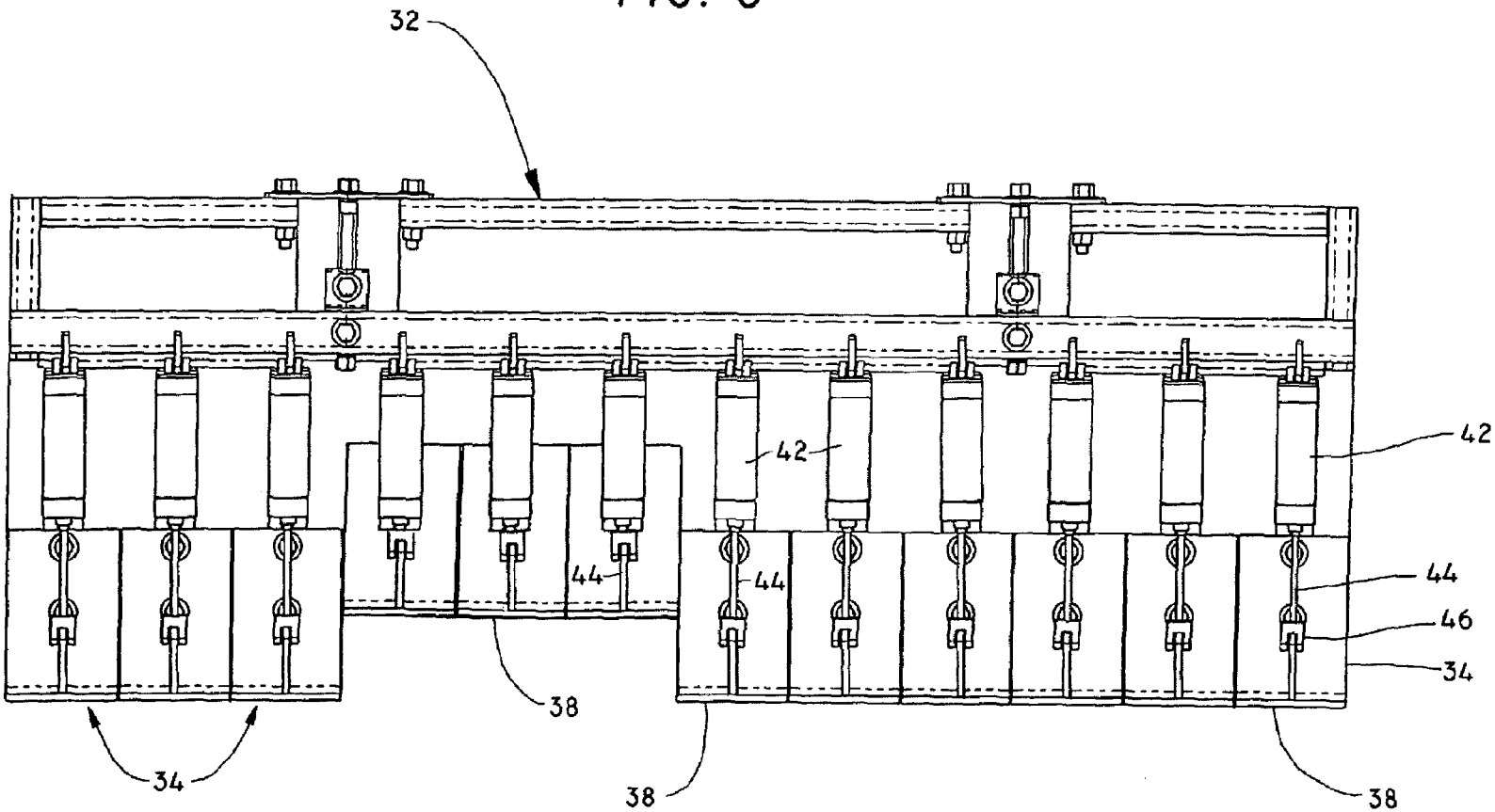
FIG. 3 is a front elevational view of the screed with segments down.

Each screed unit includes a hydraulic mechanism 40 including a hydraulic cylinder 42, piston 44 and attachment point 46 to the screed unit 34 as best shown in FIG. 2. Conventional controls for the hydraulic mechanisms 40 allow control of the vertical position of each screed unit 34 such that all may descend down to the surface 22 of the concrete to screed the concrete. Alternatively, as shown in FIGS. 1 and 3 several of the screed units 34 may be lifted free of the concrete surface 22 just before and obstruction such as the top of the form 26 only to descend thereafter to resume screeding of the entire top surface 22.

The screed 30 has been shown with a system that raises and lowers the individual screed units 34 using hydraulics. Pneumatic or any electronic control as by motors may be utilized instead.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

This completes the description of the preferred and alternate embodiments of the invention. Those skilled in the art may recognize other equivalents to the specific embodiment described herein which equivalents are intended to be encompassed by the claims attached hereto.

The invention claimed is:

1. In a machine for casting concrete panels on an elongated casting bed having a bottom and opposing side forms, the improvement comprising:

a) a segmented screed having a frame above said casting bed and a plurality of screed units, said screed units each having a lower screed plate each plate of which includes a leading edge and a flat bottom surface for contacting the concrete; and b) each of said screed units being mounted to said frame for vertical travel only such that the lower screed plates together when at a lowest position present a unified screed line to contact and screed concrete on said casting bed, each lower screed plate being mounted to said frame independently of the lower screed plates.

2. The machine of claim 1 wherein each of said screed units includes a lifting mechanism to raise and lower the screed unit such that all screed units may be raised or lowered together or selectively.

3. The machine of claim 2 wherein said lifting mechanism is hydraulically operated and each of said screed units includes a hydraulic mechanism comprising a hydraulic cylinder driving a piston attached to said screed units such that said screed units may move up and down relative to said frame.

* * * * *